US008006502B2

(12) United States Patent
Kim et al.

(10) Patent No.: US 8,006,502 B2
(45) Date of Patent: Aug. 30, 2011

(54) DISPENSER RELATED TECHNOLOGY

(75) Inventors: Seong Jae Kim, Seoul (KR); Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 642 days.

(21) Appl. No.: 12/166,826

(22) Filed: Jul. 2, 2008

(65) Prior Publication Data

US 2009/0009042 A1 Jan. 8, 2009

(30) Foreign Application Priority Data

Jul. 6, 2007 (KR) ..... 10-2007-0068160

(51) Int. Cl.
*F25C 1/00* (2006.01)

(52) U.S. Cl. ..... 62/66; 62/389; 62/390

(58) Field of Classification Search ..... 62/66, 161, 62/389, 129, 390, 440; 222/52, 146.6; 312/121, 312/124, 127, 405
See application file for complete search history.

(56) References Cited

U.S. PATENT DOCUMENTS

| | | | | |
|---|---|---|---|---|
| 5,819,547 | A | 10/1998 | Oh | |
| 6,182,453 | B1 * | 2/2001 | Forsberg | 62/125 |
| 6,497,343 | B1 | 12/2002 | Teetsel | |
| 7,269,968 | B2 * | 9/2007 | Harder et al. | 62/389 |
| 7,337,594 | B2 * | 3/2008 | Sus et al. | 53/495 |
| 7,568,359 | B2 * | 8/2009 | Wetekamp et al. | 62/135 |
| 7,617,698 | B2 * | 11/2009 | Bowen et al. | 62/264 |
| 2002/0148858 | A1 * | 10/2002 | Bertone | 222/129.4 |
| 2004/0129725 | A1 * | 7/2004 | Bertone | 222/129.4 |
| 2006/0201193 | A1 * | 9/2006 | Bowen et al. | 62/344 |
| 2006/0201194 | A1 | 9/2006 | Bowen et al. | |
| 2006/0266061 | A1 * | 11/2006 | Wetekamp et al. | 62/228.1 |
| 2007/0131711 | A1 * | 6/2007 | Minard et al. | 222/105 |
| 2007/0228152 | A1 * | 10/2007 | Washington et al. | 235/379 |

FOREIGN PATENT DOCUMENTS

| | | |
|---|---|---|
| KR | 10-2004-0013820 | 2/2004 |
| KR | 10-2005-0028360 | 3/2005 |
| KR | 10-2005-0033296 | 4/2005 |
| KR | 10-2007-0066297 | 6/2007 |
| WO | 2007/063039 | 6/2007 |

OTHER PUBLICATIONS

International Search Report & Written Opinion issued in International Application No. PCT/KR2008/003878, mailed Jun. 26, 2009, 10 pages.

* cited by examiner

*Primary Examiner* — Mohammad Ali
(74) *Attorney, Agent, or Firm* — Fish & Richardson P.C.

(57) ABSTRACT

Refrigerator including a door, a dispenser mounted to the door, the dispenser having a dispensing opening for dispensing content, a button and tray combination device for controlling the dispensing of the content, as well as holding residue from the dispensing opening after the dispensing of the content, and a sensing device for sensing a height of the residue in the button and tray combination device.

21 Claims, 7 Drawing Sheets

DISPENSER RELATED TECHNOLOGY

CROSS REFERENCE TO RELATED APPLICATIONS

This application claims the benefit of the Korean Patent Application No. P2007-0068160, filed on Jul. 6, 2007, which is hereby incorporated by reference as if fully set forth herein.

FIELD

The present disclosure relates to dispenser technology.

BACKGROUND

In general, a refrigerator may include a refrigerating compartment and a freezing compartment. The refrigerating compartment may be maintained at about 3~4° C. to enable storage of perishable food in a non-frozen state for a relatively long time without substantial spoilage, and the freezing compartment may be maintained at a sub-zero temperature to enable storage of food in a frozen state. A refrigerator may include an ice maker configured to make ice and a dispenser configured to dispense liquid water and ice made by the ice maker.

SUMMARY

In one aspect, a refrigerator includes a compartment, a door configured to open and close at least a portion of the compartment, and a dispenser that is positioned on a surface of the door and that is configured to dispense content through a dispenser outlet. The refrigerator also includes a button and tray combination device that is configured to control the dispenser to dispense content through the dispenser outlet and that is configured to receive and store residual content discharged from the dispenser outlet after a container used in actuating the button and tray combination device is moved from beneath the dispenser outlet. The refrigerator further includes a sensing device configured to sense an amount of residual content stored in the button and tray combination device, and a controller configured to perform an operation directed to preventing overflow of the button and tray combination device based on the sensing device sensing that the amount of residual content exceeds a threshold.

Implementations may include one or more of the following features. For example, the button and tray combination device may include a button switch configured to control the dispenser to dispense content, a button tray defining a storage space configured to store the residual content, and a tray drive mechanism configured to move the button tray away from the door surface in the absence of force applied to the button tray in a direction that is toward the door surface, and to change a position of the button tray from a misaligned position in which the button tray is misaligned with the dispenser outlet to a receiving position in which the button tray is aligned with and captures content dispensed through the dispenser outlet, where the tray drive mechanism allows the button tray to move into the misaligned position in response to force that is applied to the button tray and where the tray drive mechanism causes the button tray to move into the receiving position in response to removal of force that is applied to promote positioning of the button tray in the misaligned position.

In some implementations, the sensing device includes a sensor configured to sense a height of the residual content stored in the button tray, and the controller is configured to perform the operation directed to preventing overflow of the button and tray combination device based on the sensing device sensing that the height of residual content stored in the button tray exceeds a threshold. In these implementations, the sensor may be an optical sensor including a light emitting element mounted to a first wall of the button tray and a light receiving element mounted to a second wall of the button tray that is opposite of the first wall. The light emitting element may be mounted to a surface of the first wall opposite of the storage space. The first wall may include a light transmission window configured to permit transmission of light from the light emitting element through the first wall.

In some examples, the sensor may be an electrode sensor mounted to a wall of the button tray. The electrode sensor may be mounted to a surface of the wall defining the storage space. The electrode sensor also may include a first electrode of a first length and a second electrode of a second length that is different than the first length. The first electrode may be configured to sense whether residual content stored in the button tray has reached a first level and the second electrode may be configured to sense whether residual content stored in the button tray has reached a second level that is different than the first level. The controller may be configured to compare the sensed height to a threshold height, and to trigger the operation directed to preventing overflow of the button and tray combination device responsive to comparison results demonstrating that the sensed height exceeds the threshold height.

The refrigerator may include an informing device configured to generate a perceivable output. The controller may be configured to control the informing device to generate a perceivable output indicating that the amount of residual content sensed by the sensing device exceeds the threshold. The informing device may be mounted to a tray portion of the button and tray combination device.

In some implementations, the refrigerator may include a discharging device configured to discharge residual content stored in the button and tray combination device from the button and tray combination device. In these implementations, the controller may be configured to control the discharging device to discharge residual content from the button and tray combination device in response to the sensing device sensing that the amount of residual content exceeds the threshold. The discharging device may include a drain valve configured to control a flow of residual content from the button and tray combination device, a motor configured to drive the drain valve, and a drain pipe configured to guide residual content discharged from the button and tray combination device.

The refrigerator further may include a display unit configured to display information based on the amount of residual content sensed by the sensing device. The dispenser may includes a moving chute that is configured to move between an operable position in which the moving chute is at least partially positioned on a side of the surface of the door opposite of the compartment, and a stored position in which the moving chute is positioned entirely on a side the surface of the door where the compartment is positioned, where the moving chute has structure that defines at least a portion of a passage through which content is discharged from the dispenser. A tray portion of the button and tray combination device may be configured to move to an extended position when the moving chute moves to the operable position, the extended position being a position in which the tray portion of the button and tray combination device is at least partially positioned on a side of the surface of the door opposite of the compartment.

In another aspect, a method for controlling a refrigerator includes receiving, in a button tray that is configured to control a dispenser to dispense content through a dispenser outlet, residual content discharged from the dispenser outlet after a container used in actuating the button tray is moved from beneath the dispenser outlet, sensing an amount of residual content stored in the button tray, and performing an operation directed to preventing overflow of the button tray in response to sensing that the amount of residual content stored in the button tray exceeds a threshold.

Implementations may include one or more of the following features. For example, performing an operation directed to preventing overflow of the button tray may include generating an output that indicates that the amount of residual content stored in the button tray exceeds the threshold. In another example, performing an operation directed to preventing overflow of the button tray may include discharging residual content from the button tray in response to sensing that the amount of residual content stored in the button tray exceeds a threshold.

In some implementations, sensing the amount of residual content stored in the button tray may include sensing whether residual content stored in the button tray has reached a particular level. Sensing the amount of residual content stored in the button tray may include sensing, from among at least two levels of content, a level of residual content stored in the button tray.

In yet another aspect, a refrigerator includes a compartment, a door configured to open and close at least a portion of the compartment, and a dispenser that is positioned on a surface of the door and that is configured to dispense content through a dispenser outlet. The refrigerator also includes a button and tray combination device that is configured to control the dispenser to dispense content through the dispenser outlet and that is configured to receive and store residual content discharged from the dispenser outlet after a container used in actuating the button and tray combination device is moved from beneath the dispenser outlet. The refrigerator further includes means for sensing an amount of residual content stored in the button and tray combination device, and means for performing an operation directed to preventing overflow of the button and tray combination device in response to sensing that the amount of residual content stored in the button and tray combination device exceeds a threshold.

DETAILED DESCRIPTION

Figure 1:
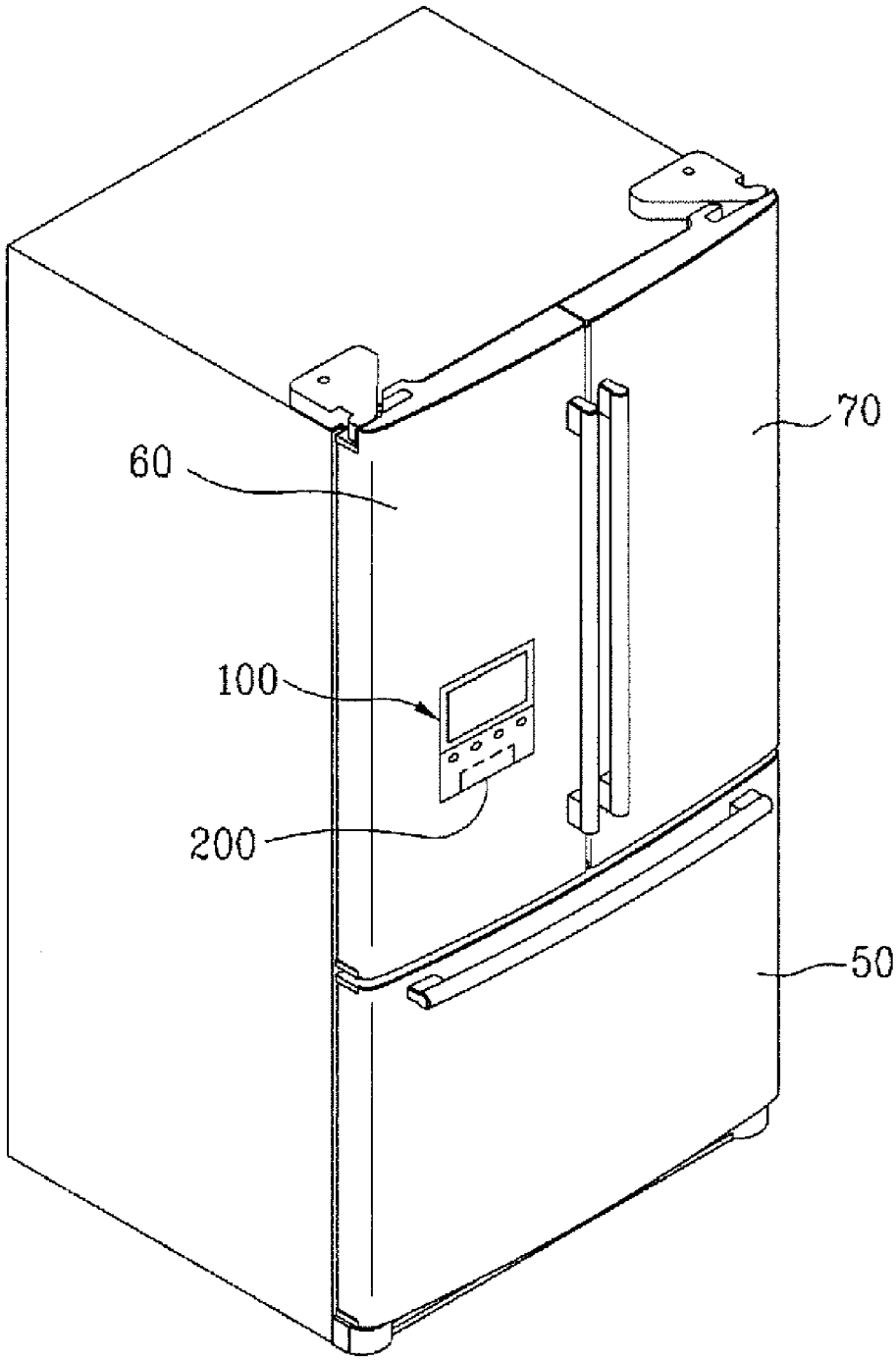
FIG. 1 is a perspective view illustrating a refrigerator.

The refrigerator includes a freezing compartment configured to store food at a temperature below freezing, and a refrigerating compartment configured to store food at a cool temperature that is higher than freezing. The refrigerator includes a freezing compartment door 50 arranged at a front side of the freezing compartment and configured to open and close the freezing compartment and refrigerating compartment doors 60 and 70 are arranged at a front side of the refrigerating compartment and configured to open and close the refrigerating compartment. The freezing compartment is located under the refrigerating compartment when the refrigerator is oriented in an ordinary operating position. The refrigerating compartment may be divided into two blocks.

In implementations in which the refrigerating compartment is divided in two blocks, the refrigerating compartment has a first refrigerating compartment and a second refrigerating compartment. In these implementations, the refrigerating compartment doors 60 and 70 have a first refrigerating compartment door 60 and a second refrigerating compartment door 70 for opening/closing the first refrigerating compartment and the second refrigerating compartment, respectively. The first and second refrigerating compartment doors 60 and 70 are pivotally coupled to opposite side walls of a refrigerator body by hinges such that the doors 60 and 70 may be pivotally opened and closed. The freezing compartment door 50 is opened and closed in a sliding manner in forward and rearward directions of the refrigerator body.

The freezing and refrigerating compartment doors may be arranged at various positions in accordance with the positions of the freezing and refrigerating compartments. For example, the refrigerator may include various styles of refrigerators, for example, a refrigerator with a top mount freezing compartment and side-by-side style refrigerators that include side-by-side refrigerating and freezing compartments.

A dispenser 100 may be mounted to a front surface of the refrigerating compartment door for dispensing content, e.g., water or ice. A button and tray combination device 200 configured to receive and store residue after dispensing the content, e.g., water or ice, may be positioned under the dispenser 100. The button and tray combination device 200 has a sensing device (see FIG. 2) mounted thereto for sensing a height of the residue or content stored in the button and tray combination device 200.

Figure 2:
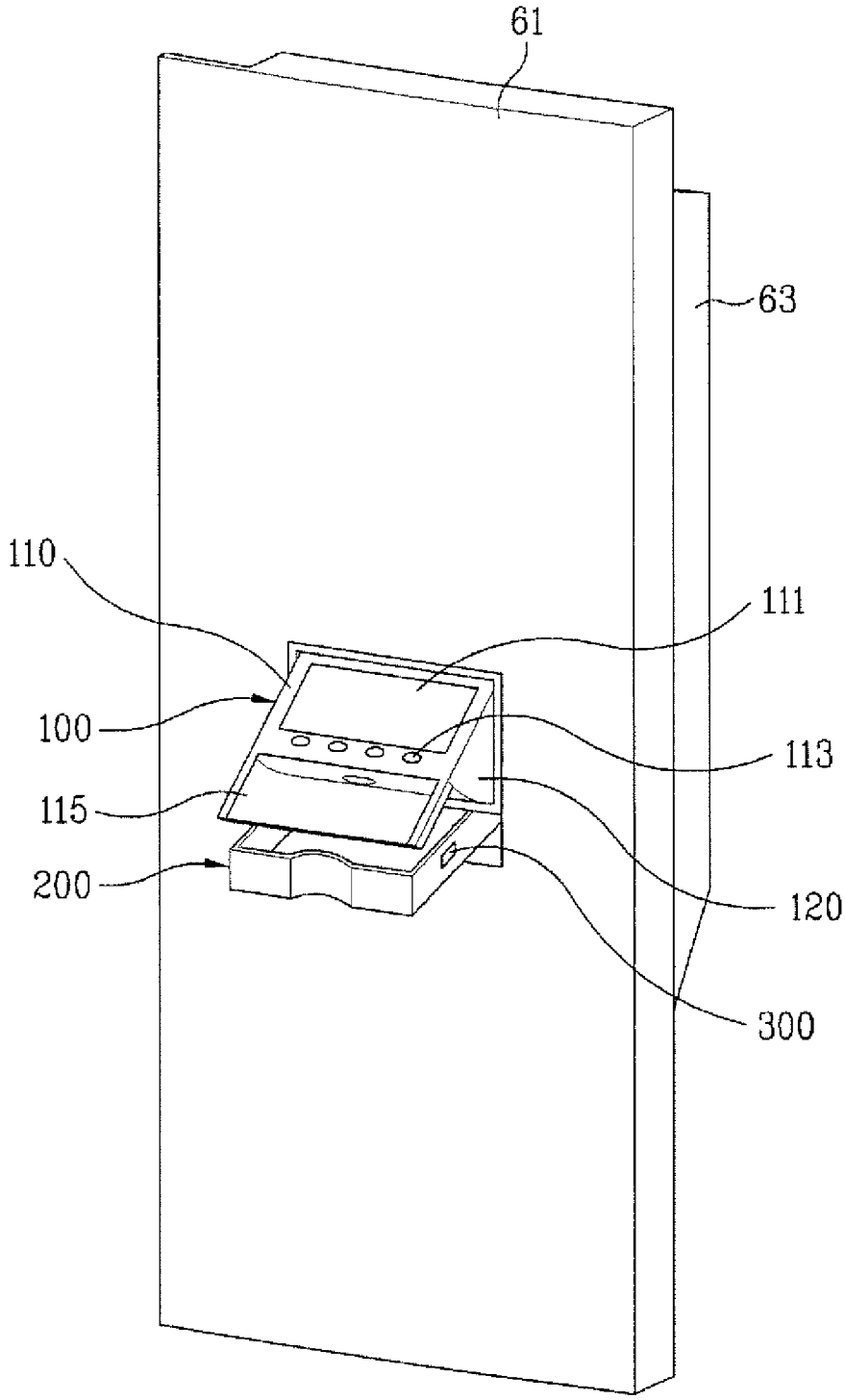
FIG. 2 is a perspective view illustrating a front of the door when the dispenser included in the refrigerator in FIG. 1 is in an operable position.

FIG. 2 illustrates a front of a door when a dispenser included in the refrigerator shown in FIG. 1 is in an operable position. The first refrigerating compartment door has a front frame 61 and a rear frame 63. A portion of the front frame 61 is exposed to an outside of the refrigerator, and a portion of the rear frame 63 is exposed to a body of the refrigerator when the refrigerating compartment door 60 is in a closed position.

Between the front frame 61 and the rear frame 63, a space is defined. In the space, an ice maker (not shown) that is in communication with the freezing compartment and that is configured to make ice, an ice holding container (not shown) configured to store ice made by the ice maker, and a water tank (not shown) configured to store water are installed.

The dispenser 100 is positioned on the door and at least a portion of the dispenser is configured to fit in the space defined between the front frame 61 and the rear frame 63 when the dispenser is in a stored position. The dispenser 100 also is connected to the water tank and the ice holding container to receive water or ice for dispensing.

The dispenser 100 includes a moving chute 120 configured to move between a stored position and an operable position. In the operable position, at least a portion of the moving chute 120 is positioned outside of the front frame 61 to define an ice passage through the door. In the stored position, at least a portion of the moving chute 120 is positioned in the space defined between the front frame 61 and the rear frame 63. The dispenser 100 also includes a dispensing cover 110, which may be configured to move between a stored position and an operable position together with the moving chute 120. In the stored position, the dispensing cover 110 may be positioned flush with a surface of the door.

Control buttons 113 configured to control dispensing of ice or water, and a display unit 111 configured to display a dispensing state may be mounted to the dispensing cover 110. The display unit 111 may display information related to an amount of residual content stored in the button tray 210 as described in more detail below.

The dispensing cover 110 has a transparent panel 115 to allow a user to view the button and tray combination device 200 from an outside of the dispensing cover 110. Thus, a user may perceive, through the transparent panel 115, a dispensed amount filled in a container through a dispenser outlet of the moving chute. The transparent panel 115 enables a user to view ice or water being dispensed into a container to ensure the container is positioned such that the ice or water being dispensed is received in the container and also to determine when to stop dispensing because the container has been filled to a desired level.

As shown in FIG. 2, the dispensing cover 110 and the moving chute 120 are structurally connected (e.g., provided as one body or integrated). For instance, the dispensing cover 110 and the moving chute 120 constitute one dispenser housing, wherein the dispensing cover defines an external appearance of the dispensing housing and the moving chute defines an interior of the dispensing housing. In these configurations, the dispensing cover 110 and the moving chute 120 move together as the moving chute 120 is drawn in/out of the door.

In addition, a sensing device 300 may be mounted to the button tray composite device 200 that senses a height of the content (e.g., residue) stored in the button and tray combination device 200.

The sensing device 300 may include a sensor that senses the height of the content (e.g., residue), and a control unit (not shown) that controls emission of an alarm when a height of the content (e.g., residue) reaches a predetermined level.

The sensor may be a variety of optical sensors for sensing a body, such as an infrared sensor, or a UV sensor. An example of using an infrared sensor is described in more detail below.

Figure 3:
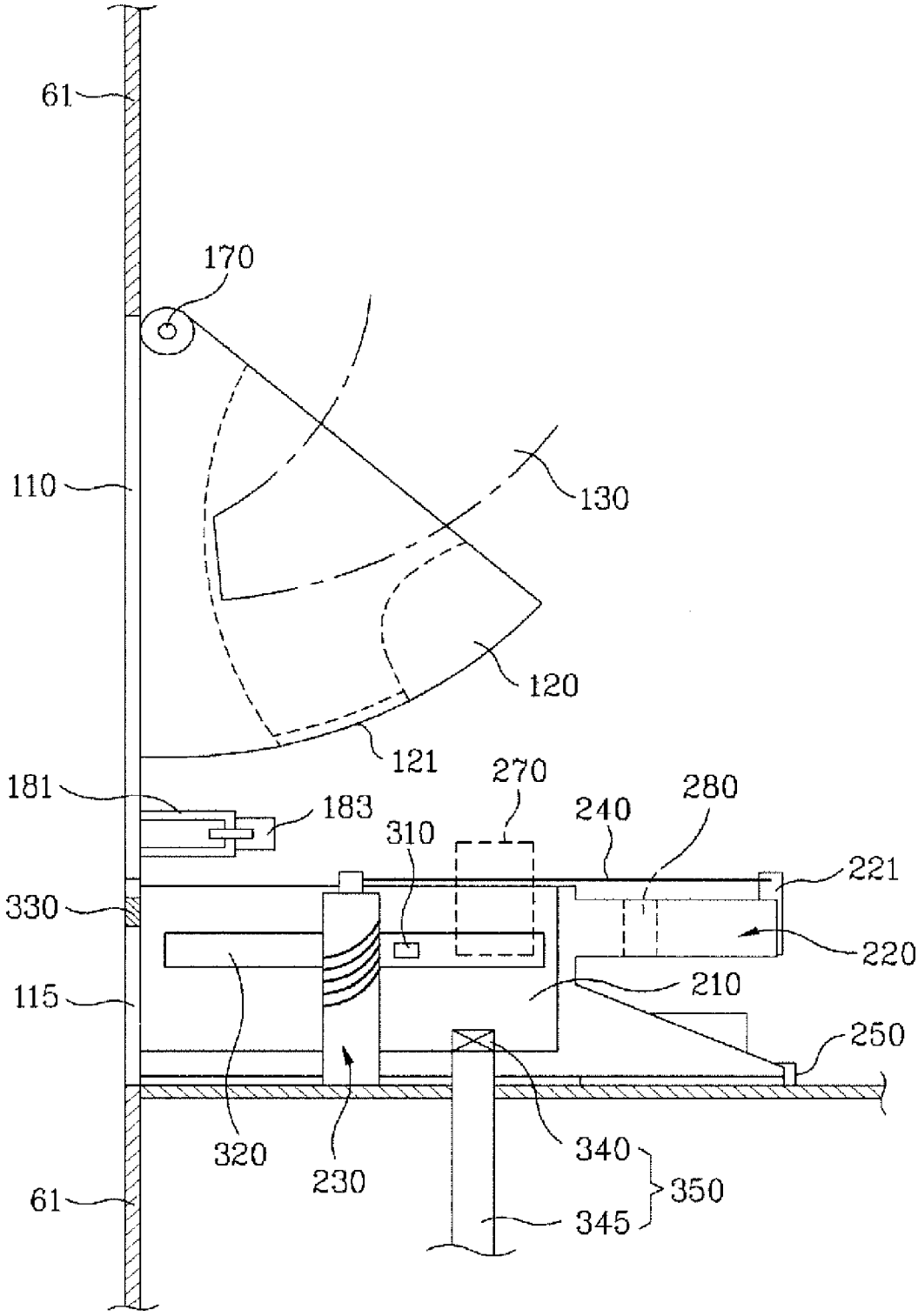
FIG. 3 is a sectional view illustrating a sensing device included in a dispenser.
Figure 4:
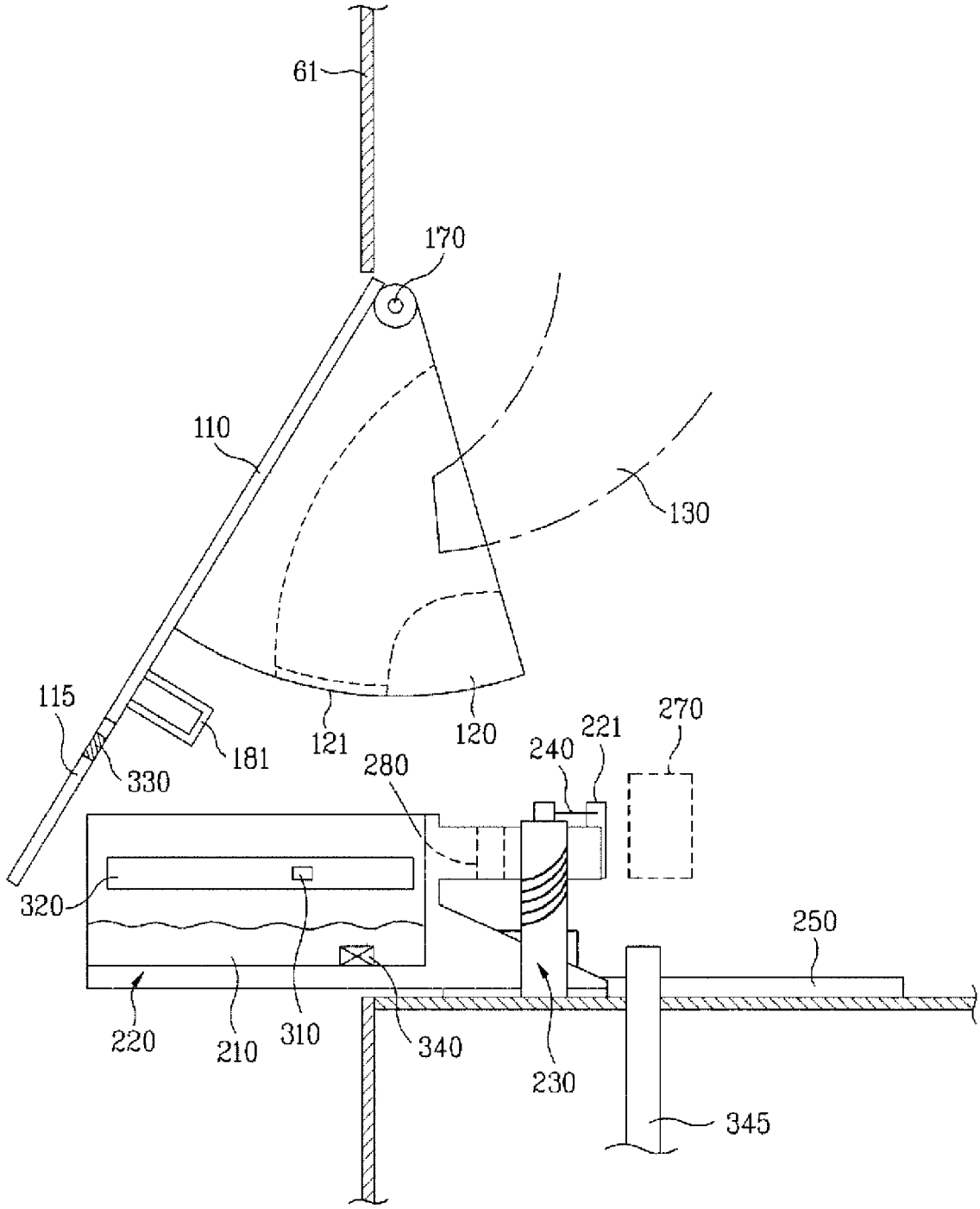
FIG. 4 is a sectional view illustrating a sensing device included in a dispenser.

FIGS. 3 and 4 illustrate a sensing device included in a dispenser. The dispenser 100 includes a stationary chute 130 having a first end that communicates with the moving chute 120, and a second end that communicates with the ice holding container, which stores ice. The stationary chute 130 is located in a space defined between the front frame 61 and the rear frame 63. The stationary chute 130 may be fastened in the space with fastening units (not shown), such as bolts/nuts, or hooks.

The moving chute 120 has a length enabling the moving chute 120 to be in communication with the stationary chute 130, regardless of whether the moving chute 120 is positioned in an operable position outside of the front frame 61 or positioned in a stored position in the space in the door defined between the front frame 61 and the rear frame 63.

An ice dispensing duct (not shown) may be mounted in the space defined between the front frame 61 and the rear frame 63 to define an ice flow passage from the ice holding container to the stationary chute 130. A duct cover (not shown) may be located at an end of the ice dispensing duct that communicates with the stationary chute 130, and may be configured to for open and close the ice dispensing duct.

A mechanical drive mechanism may be mounted at the refrigerating compartment door. The mechanical drive mechanism is configured to move the dispensing cover 110 and the moving chute 120 from a stored position to an operable position in which the dispensing cover 110 and moving chute 120 are positioned outside of the front frame.

The mechanical drive mechanism includes a hinge unit 170 that allows the dispensing cover 110 connected to the moving chute 120 to pivot or rotate with respect to the front frame 61, and an elastic device (not shown) that provides an elastic force to the dispensing cover 110 and moving chute 120 to promote movement of the dispensing cover 110 and the moving chute 120 from the stored position to the operable position in which the dispensing cover 110 and moving chute 120 are positioned outside of the front frame 61. The mechanical drive mechanism also includes a coupling unit (e.g., first coupler 181 and second coupler 183) that couples the dispensing cover 110 to the front frame 61 against the elastic force provided by the elastic device, thereby retaining the dispensing cover 110 and moving chute 120 in the stored position when the coupling unit is engaged.

The coupling unit includes a first coupler 181 mounted to the dispensing cover 110, and a second coupler 183 mounted in the space in the door. The first coupler 181 and the second coupler 183 are fastened/released when the user applies force thereto.

For example, if the first coupler 181 and the second coupler 183 are pressed together, a coupling hook provided at the second coupler 183 is separated from a coupling groove provided at the first coupler 181. When the first coupler 181 is separated from the second coupler 183 and pressed, the coupling hook engages with the coupling groove (e.g., a hole), thereby coupling the first coupler 181 to the second coupler 183.

The mechanical drive mechanism may further include a damper for regulating a speed of the dispensing cover when the dispensing cover 110 moves.

Any device may be used as the damper as long as the device is configured to apply a constant force to the dispensing cover 110 and the moving chute 120 such that the dispensing cover 110 and moving chute 120 rotate at a fixed speed.

For example, a gas spring or a gearing may be used, which may apply a relatively constant force to the dispensing cover 110 and moving chute 120 against the pivotal movement of the dispensing cover 110 and moving chute 120.

The hinge unit 170 includes a hinge pins (not shown) respectively located at opposite ends of the dispensing cover 110, and a hinge grooves (not shown) located at an inner surface of the front frame 61 such that the hinge grooves correspond to the hinge pins, respectively. Accordingly, the dispensing cover 110 and the moving chute 120 rotate around the hinge shaft.

The refrigerator further may include a water dispensing duct (not shown) coupled to the dispensing cover 110, and configured to dispense water. When the dispensing cover 110 and the moving chute 120 are positioned in an operable position outside of the front frame 61 (e.g., in a water dispensing mode), the water dispensing duct (not shown) mounted to the dispensing cover 110 is positioned together with the dispensing cover 110 and moving chute 120, to enable dispensing of water from an outlet of the water discharge duct outside of the front frame 61.

The button and tray combination device 200, which is mounted under the dispenser 100, controls dispensing of content (e.g., ice or water) from the dispensing outlet of the moving chute 120. The button and tray combination device 200 also receives and stores residual content after completion of a content dispensing operation.

A controller (not shown) is mounted to one side of the space in the door. The controller includes a dispensing switch 270 configured to control dispensing of content together with the button and tray combination device 200.

The button and tray combination device 200 includes a button switch 280 that is selectively connected to the dispensing switch 270 to control dispensing of content. The button and tray combination device 200 also includes a button tray 210 having a content receiving space configured to receive and store residual content from the outlet 121 when the button tray 210 is in an extended position corresponding to and positioned under the outlet 121. The button and tray combination device 200 further includes a tray driving mechanism configured to move the button tray 210.

The button and tray combination device 200 also includes a guiding member 250 configured to guide movement of the button tray 210, and a movable member 220, which may be engaged with the button tray 210 and configured to move, together with the button tray 210, following guidance of the guiding member 250.

The movable member 220 has a button switch 280 mounted thereto for selective connection to the dispensing switch 270. For example, if the button switch 280 comes into contact with the dispensing switch 270 based on movement of the movable member 220, the controller generates a predetermined signal, and controls a dispensing operation based on the signal.

The tray drive mechanism includes an elastic member having an elastic resilience against an external force to be applied to the button tray 210. A wire spring may be used for the elastic member.

The tray drive mechanism includes a roller 230 located at one side of the inside of the door, and a wire spring 240 wound around the roller 230. The wire spring 240 is unwound from the roller 230 when an external force is applied to the button tray 210, and wound around the roller 230 when the external force is released. The wire spring 240 has one end fastened to a spring holder 221 at the movable member 220, and the other end fastened to the roller 230.

Referring to FIG. 3, an infrared sensor 310 may be mounted to an outside wall of the button tray 210. In an example in which the infrared sensor 310 is mounted to the outside wall of the button tray 210, a volume of content (e.g., residue) the button tray 210 is capable of storing is not reduced.

The infrared sensor 310 includes a light emitting unit (not shown) that emits a light, and a light receiving unit (not shown) that receives the light from the light emitting unit (not shown) to detect the light. The light emitting unit and the light receiving unit may be mounted to opposite walls of the button tray 210 such that a path of light emitted by the light emitting unit intersects the light receiving unit when an object does not obstruct light emitted by the light emitting unit prior to reaching the light receiving unit.

If the light emitting unit (not shown) directs the light to content (e.g., water or ice) stored in the button tray 210, the light is reflected or refracted by the content. The light sensed at the light receiving unit (not shown) may enable detection of a height of the content. For instance, the infrared sensor 310 may detect that a level of content is below the infrared sensor 310 when the light receiving unit senses light and may detect that a level of content is at or above the infrared sensor 310 when the light receiving unit does not sense light.

Referring to FIG. 3, the infrared sensor 310, mounted to a predetermined height of the outside wall of the button tray 210, may sense a high level of content before the content, (e.g., water or ice) overflows from the button tray 210. In some implementations, the infrared sensor 310 may includes multiple sensors positioned at different heights of the outside wall of the button tray 210 to enable sensing various levels of content (e.g., sensing water or ice at several different height or in many stages).

Figure 5:
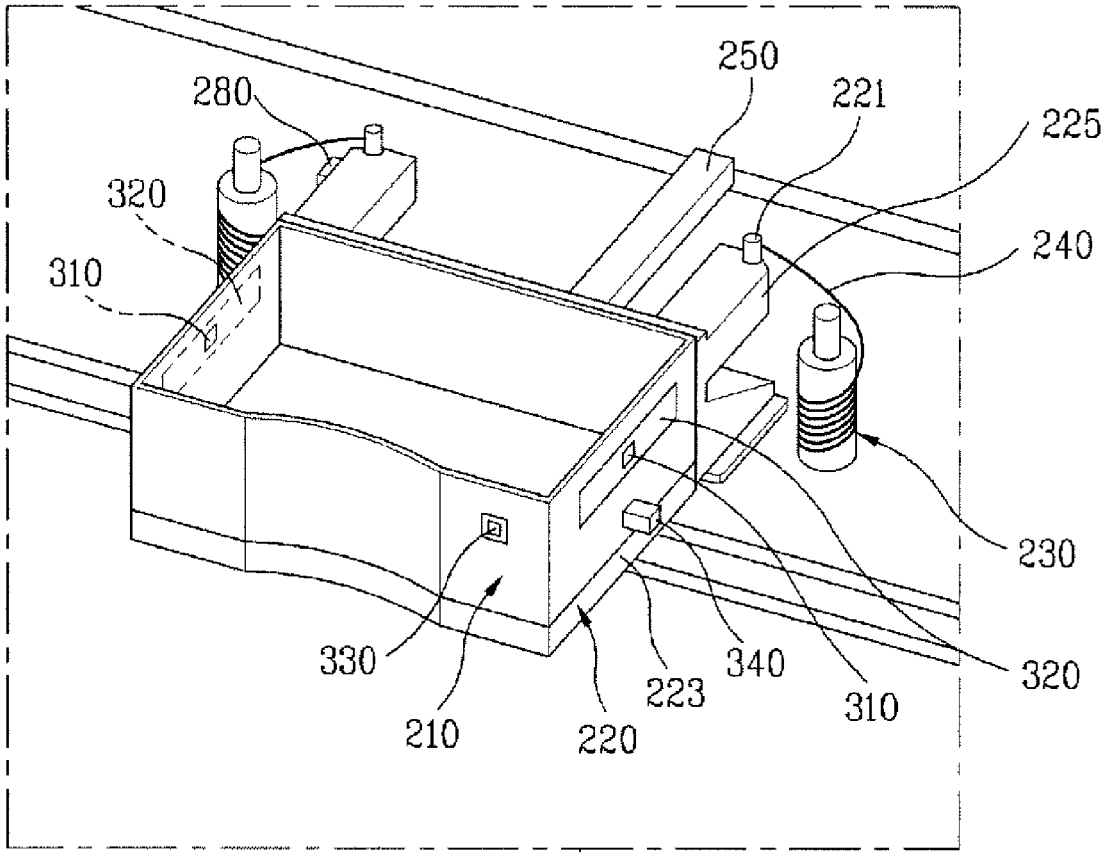
FIG. 5 is a perspective view illustrating a sensing device.

Referring to FIG. 5, the button tray 210 may have a light transmission window 320 mounted to the outside wall of the button tray 210 to enable transmission of light from the infrared sensor through the outside wall of the button tray 210. The light transmission window 320 may be formed of glass, clear plastic, or a variety of other materials that permit transmission of light.

Figure 6:
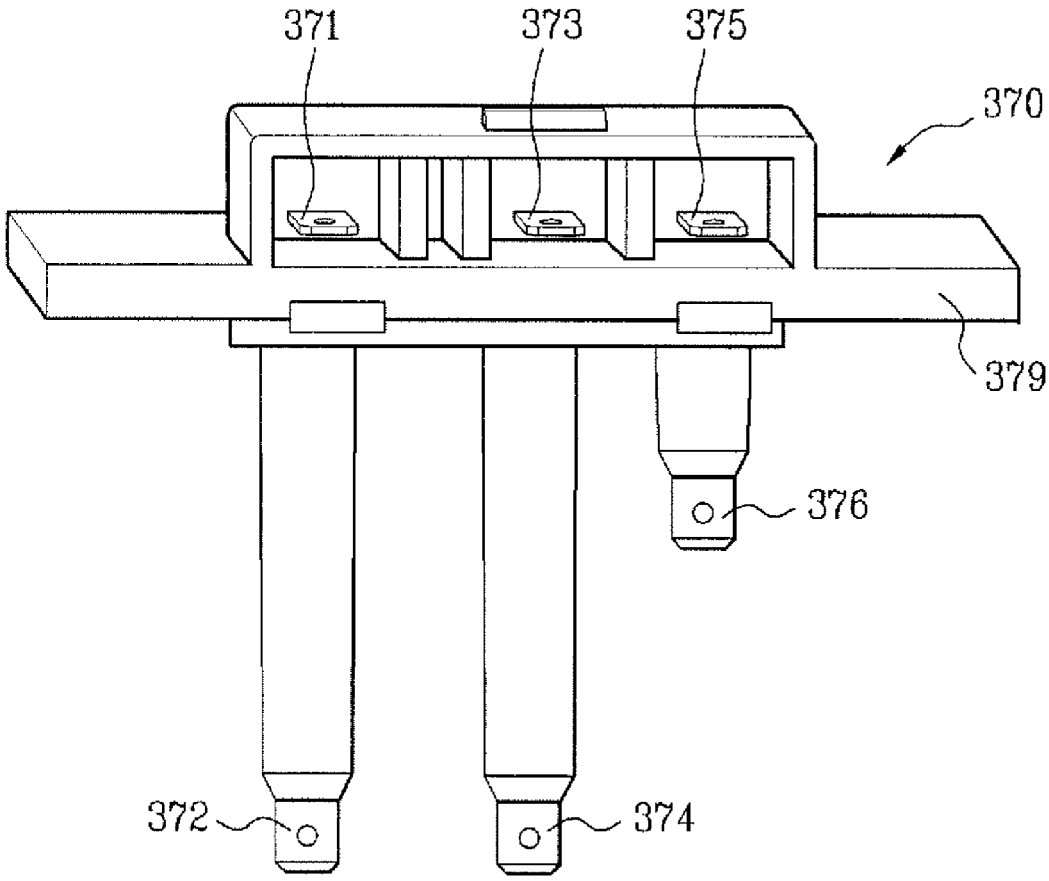
FIG. 6 is a front view illustrating a sensing device.
Figure 7:
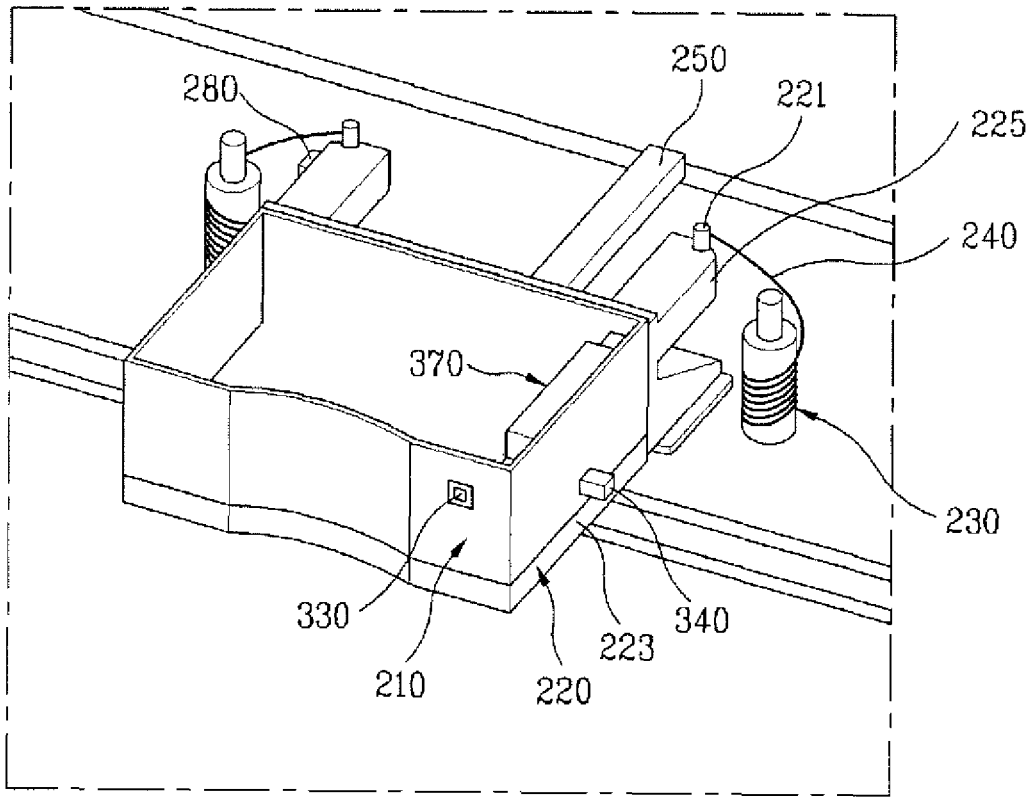
FIG. 7 is a perspective view illustrating the sensing device in FIG. 6 mounted to a button tray.

Referring to FIGS. 6 and 7, the sensing device may be an electrode sensor 370 positioned on an inside wall of the button tray 210.

The electrode sensor 370 includes a fastening portion that attaches the electrode sensor 370 to the button tray 210, an electrode portion, mounted to an underside of the fastening portion, that senses a level of content (e.g., water or ice) in the button tray 210, and a terminal that is electrically connected to an outside of the electrode sensor 370 in correspondence to the electrode portion.

The fastening portion 379 may be fastened to the inside wall of the button tray 210 with bolts or other fastening members. Other fastening mechanisms may be used.

Each of the electrodes in the electrode portion may be mounted at a predetermined height from a bottom of the button tray 210 that senses the level of the content (e.g., water or ice) in the button tray 210. The predetermined height of each of the electrodes may be different to enable sensing at different heights.

In some implementations, the electrode portion has a common electrode 372 which is a reference electrode for sensing the level, a low level electrode 374 for sensing a low level, and a high level electrode 376 for sensing a high level. For multistage/multi-height sensing of the level of the content, a plurality of electrodes with differing heights/lengths may be included in the electrode portion.

The electrode sensor 370 has a common electrode terminal 371, a low level terminal 373, and a high level terminal 375. The common electrode terminal 371, the low level terminal 373, and the high level terminal 375 correspond to the common electrode 372, the low level electrode 374, and the high level electrode 376, respectively.

The low level electrode 374 senses a low level of content. Because the low level electrode 374 senses a level of content based on a connection with the common electrode 372, the common electrode 372 has a length that is at least equal to a length of the low level electrode 374. The length of the common electrode 372 may be greater than a length of the low level electrode 374.

If the level of the water or the ice reaches to the common electrode 372 and the low level electrode 374, a current flows through the water, to generate a low level signal. If the level of the content (e.g., water or ice) rises to the high level electrode 376, the current flows to generate a high level signal.

Referring to FIGS. 3-7, data sensed at the infrared sensor 310 or the electrode sensor 370 is transmitted to the controller (not shown) for processing.

The controller controls an informing device 330 and a discharging device 350 based on data received from the sensor (e.g., the infrared sensor 310 or the electrode sensor 370).

The informing device 330 may be located on a front surface of the refrigerating compartment door or on a front surface of the button tray 210. The informing device 330 enables a user to perceive from an outside of the door when the content in the button tray 210 reaches to a certain height. The informing device 330 may alert the user to a level of content in the button tray 210 when the user otherwise is unable to perceive the level of content in the button tray 210 (e.g., when the button tray is positioned in a stored position within a space defined in the door).

The informing device 330 may generate an acoustic, or visual output or alert. The informing device 330 may output an alarm, or emit a light when the level of the residue in the button tray 210 reaches to a certain height.

Referring to FIG. 4, the informing device 330 may be mounted to a front surface of the button tray 210 to able a user to view the informing device 330 from outside of the door (e.g., through the transparent panel 115). The informing device 330 also may be mounted to the display unit 111, or in another location that a user may perceive from outside of the door.

In some examples, the user may determine a state of the content (e.g., residue) in the button tray with the display unit 111. For example, the display unit 111 may display an indication when the content reaches a predetermined level. The displayed indication may be an alert or display a level of the content currently stored in the button tray 210.

The user may be alerted to a level of content (e.g., residue) in the button tray 210 with an alarm, or light outputted by the informing device 330. Alerting the user to the level of content in the button tray 210 may enable the user to dispose of the content (e.g., water or ice) from the button tray 210 before it overflows.

In some implementations, a discharging device 350 may be provided to the inside space of the door to discharge content (e.g., residue) from the button tray 210 to the outside of the door.

The discharging device 350 includes a drain valve 340 configured to open and close a drain pipe 345 to control flow of content (e.g., residue) from the button tray 210. A motor (not shown) configured to drive the drain valve 340 may be provided, and the drain pipe 345 may define a passage for discharging the content (e.g., residue) to the outside of the door.

Referring to FIG. 3, the drain valve 340 may be mounted to the side wall of the button tray 210 to enable discharge of content (e.g., residue) when the content (e.g., residue) reaches a certain level. The drain valve 340 also may be mounted to an underside or a rear wall of the button tray 210.

When the level of the content (e.g., residue) reaches a certain level, the controller drives the motor. The motor opens the drain valve 340 to drain the content (e.g., residue) to the outside of the door through the drain pipe 345.

Operation of the sensing device is described below with reference to FIGS. 2 to 4. In order to dispense content (e.g., water or ice), a user pushes a lower side of the dispensing cover 110.

In response to pushing a lower side of the dispensing cover 110, both the dispensing cover 110 and the button tray 210 are moved (e.g., simultaneously) to an operable position in which the dispensing cover 110 and the button tray 210 are positioned outside of the front frame 61. For instance, the dispensing cover 110 is projected outside of the front frame 61 with the elastic force of the elastic device at the moving chute 120, and the button tray 210 is projected outside of the front frame 61 with the elastic force of the elastic member (e.g., the wire spring 240) at the tray drive mechanism.

A user brings a container into contact with the button tray 210 and pushes the button tray 210 with the container toward an inside of the door. The moving member 220 connected with the button tray 210 moves to the inside of the door guided by the guide member 250 together with the button tray 210.

If the moving member moves to a particular location, the button switch 280 on the button tray 210 is connected to the dispensing switch 270 in the door. When the button switch 280 connects to the dispensing switch 270, the controller causes the dispenser to dispense content (e.g., water or ice) through the dispenser outlet 121 based on the signal generated resulting from connection of the button switch 280 and the dispensing switch 270.

In this example, the controller causes the dispenser to dispense content (e.g., water or ice) through the dispenser outlet 121 only in a state in which the moving chute 120 is positioned in an operable position outside of the front frame 61. That is, when both the moving chute and the button tray 210 are positioned in a stored position inside of the door, content (e.g., water or ice) is not dispensed, even if the button switch 280 connects to the dispensing switch 270.

If the user pushes the dispensing cover 110 toward the inside of the door, the moving chute 120 and the button tray 210 are moved to a stored position inside of the door. When the dispenser and the button tray 210 are in the stored position, the button tray 210 may receive content (e.g., residue) from the dispenser outlet 121 because the button tray 210 remains under the dispensing opening 121 in the stored position.

After the button tray 210 is moved to the stored position in the inside space of the door, the content (e.g., residue) at the dispensing opening 121 or the content, from the inside space of the door may be received in the button tray 210. If the content (e.g., residue) continues to be received in the button tray 210, the content may overflow and come into contact with the electric components in the inside space of the door, thereby causing electric shock or short circuit.

Using a sensor to sense a level of content in the button tray 210 and an informing device 330 to inform a user of the level of content in the button tray 210, may reduce the risk of overflow and the corresponding risk of damage or injury caused by overflow. If the content (e.g., water or ice) reaches to a certain height or level, the infrared sensor 310 senses the level. If the infrared sensor 310 senses the certain height or level of content, the sensed data is provided to the controller as an electric signal.

The controller (not shown) controls the informing device 330 to generate an alarm to discharge the residue with reference to the sensed data. The informing device 330 generates a signal the user may notice from an outside of the refrigerator.

Based on an alarm the user may hear, or a light emitting device the user may see, the user may notice, from outside of the door, that the button tray 210 is full (or nearly full) of content. In response to output of the informing device 330, the user may draw the button tray 210 to the outside of the refrigerator, and empty the content (e.g., water or ice) from the button tray 210.

When content in the button tray 210 reaches a certain height, a user may control the discharging device 350 using the controller or the controller may control the discharging device 350 automatically without user input. When the controller drives the motor (not shown), the drain valve 340 at the button tray 210 is opened. The content may be drained to an outside of the refrigerator through the drain valve 340 and the drain pipe 345 when the drain valve 340 is opened.

The sensing device that senses a height of content (e.g., residue) in the button and tray combination device may prevent the content (e.g., residue) from overflowing. Accordingly, short circuit or fault of electric components in the refrigerator caused by overflow may be reduced. A user also may determine a state or level of content (e.g., residue) in the button tray from an outside of the refrigerator.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a compartment;

a door configured to open and close at least a portion of the compartment;

a dispenser that is positioned on a surface of the door and that is configured to dispense content through a dispenser outlet a button and tray combination device that is configured to control the dispenser to dispense content through the dispenser outlet and that is configured to receive and store residual content discharged from the dispenser outlet after a container used in actuating the button and tray combination device is moved from beneath the dispenser outlet;

a sensing device configured to sense an amount of residual content stored in the button and tray combination device; and a controller configured to perform an operation directed to prevent overflow of the button and tray combination device based on the sensing device sensing that the amount of residual content exceeds a threshold.

2. The refrigerator of claim 1, wherein the button and tray combination device includes:

a button switch configured to control the dispenser to dispense content, a button tray defining a storage space configured to store the residual content, and a tray drive mechanism configured to move the button tray away from the door surface in the absence of force applied to the button tray in a direction that is toward the door surface, and to change a position of the button tray from a misaligned position in which the button tray is misaligned with the dispenser outlet to a receiving position in which the button tray is aligned with and captures content dispensed through the dispenser outlet, where the tray drive mechanism allows the button tray to move into the misaligned position in response to force that is applied to the button tray and where the tray drive mechanism causes the button tray to move into the receiving position in response to removal of force that is applied to promote positioning of the button tray in the misaligned position.

3. The refrigerator of claim 2, wherein the sensing device includes a sensor configured to sense a height of the residual content stored in the button tray, wherein the controller is configured to perform the operation directed to preventing overflow of the button and tray combination device based on the sensing device sensing that the height of residual content stored in the button tray exceeds a threshold.

4. The refrigerator of claim 3, wherein the sensor is an optical sensor including a light emitting element mounted to a first wall of the button tray and a light receiving element mounted to a second wall of the button tray that is opposite of the first wall, the light emitting element being mounted to a surface of the first wall opposite of the storage space.

5. The refrigerator of claim 4 wherein the first wall includes a light transmission window configured to permit transmission of light from the light emitting element through the first wall.

6. The refrigerator of claim 3, wherein the sensor is an electrode sensor mounted to a wall of the button tray, the electrode sensor being mounted to a surface of the wall defining the storage space.

7. The refrigerator of claim 6 wherein the electrode sensor includes a first electrode of a first length and a second electrode of a second length that is different than the first length, the first electrode being configured to sense whether residual content stored in the button tray has reached a first level and the second electrode being configured to sense whether residual content stored in the button tray has reached a second level that is different than the first level.

8. The refrigerator of claim 3 wherein the controller is configured to compare the sensed height to a threshold height, and to trigger the operation directed to preventing overflow of the button and tray combination device responsive to comparison results demonstrating that the sensed height exceeds the threshold height.

9. The refrigerator of claim 1, further comprising an informing device configured to generate a perceivable output, wherein the controller is configured to perform the operation directed to preventing overflow of the button and tray combination device by controlling the informing device to generate a perceivable output indicating that the amount of residual content sensed by the sensing device exceeds the threshold.

10. The refrigerator of claim 9, wherein the informing device is mounted to a tray portion of the button and tray combination device.

11. The refrigerator of claim 1, further comprising a discharging device configured to discharge residual content stored in the button and tray combination device from the button and tray combination device, wherein the controller is configured to perform the operation directed to preventing overflow of the button and tray combination device by controlling the discharging device to discharge residual content from the button and tray combination device in response to the sensing device sensing that the amount of residual content exceeds the threshold.

12. The refrigerator of claim 11, wherein the discharging device includes:

a drain valve configured to control a flow of residual content from the button and tray combination device, a motor configured to drive the drain valve, and a drain pipe configured to guide residual content discharged from the button and tray combination device.

13. The refrigerator of claim 1, further comprising a display unit configured to display information based on the amount of residual content sensed by the sensing device.

14. The refrigerator of claim 1, wherein the dispenser includes a moving chute that is configured to move between an operable position in which the moving chute is at least partially positioned on a side of the surface of the door opposite of the compartment, and a stored position in which the moving chute is positioned entirely on a side the surface of the door where the compartment is positioned, where the moving chute has structure that defines at least a portion of a passage through which content is discharged from the dispenser.

15. The refrigerator of claim 14, wherein a tray portion of the button and tray combination device is configured to move to an extended position when the moving chute moves to the operable position, the extended position being a position in which the tray portion of the button and tray combination device is at least partially positioned on a side of the surface of the door opposite of the compartment.

16. A method for controlling a refrigerator comprising:

receiving, in a button tray that is configured to control a dispenser to dispense content through a dispenser outlet, residual content discharged from the dispenser outlet after a container used in actuating the button tray is moved from beneath the dispenser outlet;

sensing an amount of residual content stored in the button tray; and performing an operation directed to prevent overflow of the button tray in response to sensing that the amount of residual content stored in the button tray exceeds a threshold.

17. The method of claim 16, wherein performing an operation directed to preventing overflow of the button tray comprises generating an output that indicates that the amount of residual content stored in the button tray exceeds the threshold.

18. The method of claim 16, performing an operation directed to preventing overflow of the button tray comprises discharging residual content from the button tray in response to sensing that the amount of residual content stored in the button tray exceeds a threshold.

19. The method of claim 16, wherein sensing the amount of residual content stored in the button tray comprises sensing whether residual content stored in the button tray has reached a particular level.

20. The method of claim 16, wherein sensing the amount of residual content stored in the button tray comprises sensing, from among at least two levels of content, a level of residual content stored in the button tray.

21. A refrigerator comprising:

a compartment;

a door configured to open and close at least a portion of the compartment;

a dispenser that is positioned on a surface of the door and that is configured to dispense content through a dispenser outlet a button and tray combination device that is configured to control the dispenser to dispense content through the dispenser outlet and that is configured to receive and store residual content discharged from the dispenser outlet after a container used in actuating the button and tray combination device is moved from beneath the dispenser outlet;

means for sensing an amount of residual content stored in the button and tray combination device; and means for performing an operation directed to prevent overflow of the button and tray combination device in response to sensing that the amount of residual content stored in the button and tray combination device exceeds a threshold.

* * * * *